United States Patent [19]

Jang

[11] Patent Number: 4,542,667

[45] Date of Patent: Sep. 24, 1985

[54] TOOL HANDLE

[76] Inventor: Young H. Jang, San Francisco Calle 72, Casa 38, Panama City, Panama

[21] Appl. No.: 588,220

[22] Filed: Mar. 12, 1984

[51] Int. Cl.[4] ..... B25B 13/00

[52] U.S. Cl. ..... 81/177.2; 81/177.4; 81/177.6

[58] Field of Search ..... 81/177 E, 177 A, 177 D, 81/177 PP; 145/61 L, 65, 77, 75, 76

[56] References Cited

U.S. PATENT DOCUMENTS 1,036,379 8/1912 Tibbals ..... 145/61 L
1,512,176 10/1924 Johnson ..... 145/75
2,726,695 12/1955 Malm ..... 145/61 L
3,186,009 6/1965 Simmons ..... 145/61 L

*Primary Examiner*—James L. Jones, Jr.
*Attorney, Agent, or Firm*—Roger A. Marrs

[57] ABSTRACT

A handle is disclosed herein for detachably connecting with a selected tool having a central rod terminating at one end in a cross bar having pivotally mounted grip members adapted to rotate laterally from opposite sides of a handle body from a storage position to an operative position whereby the members are coextensive in linear alignment. A spring biasing mechanism yieldably urges the members to either of the alternate positions.

6 Claims, 4 Drawing Figures

FIG. 1
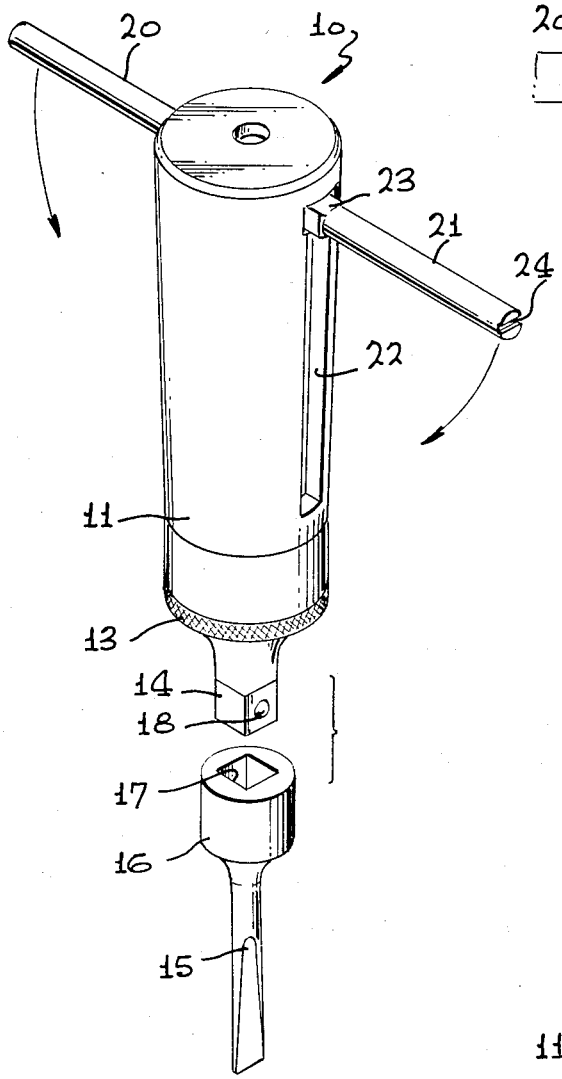
FIG. 2
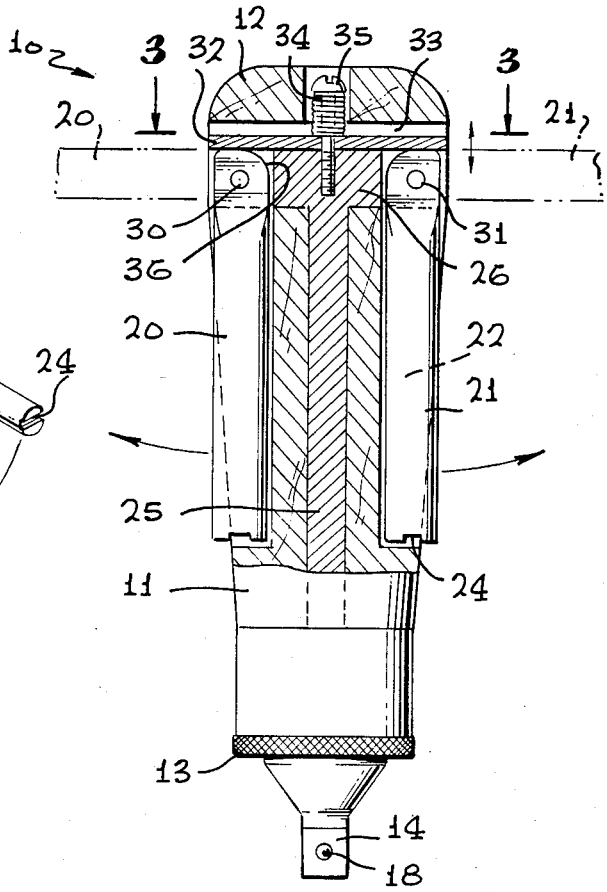
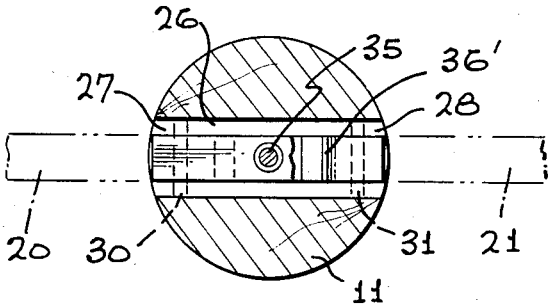
FIG. 3
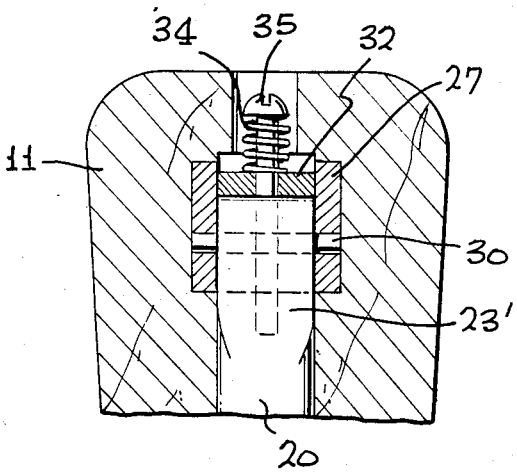
FIG. 4

TOOL HANDLE

BACKGROUND OF THE INVENTION

1. Field of the Invention

The present invention relates to hand tools and, more particularly, to a novel handle having pivotal members extending from opposite sides thereof adapted to be grasped by the hands of the user for twisting or turning the tool in order to obtain greater torque.

2. Brief Description of the Prior Art

In the past, it has been the conventional practice to provide an elongated handle for hand tools which is generally of a round or barrel shape having elongated flutes provided along the length thereof. A tool is carried on one end of the handle and, in use, the hand of the user grasps the handle and twists or turns the tool either clockwise or counterclockwise as desired.

However, problems and difficulties have been encountered when using conventional hand tools such as screwdrivers, socket wrenches or the like which incorporate a linear handle that stem largely from the fact that the user's hand does not develop sufficient torque for turning unusually tightened screws or nuts or such components which are rusted, oxidized or otherwise stuck to surrounding work pieces. The tendency of the user's hand is to rotate in a longitudinally parallel axis to the axis of the linear handle which promotes a weaker grip.

An alternate procedure is often time used by a workman who will employ a pair of pliers for gripping the handle of a screwdriver or linear wrench and with the pliers extending outwardly in a transverse or lateral direction, apply a rotating pressure to the tool. Such a procedure provides increased leverage and thereby torque for turning the tool and the work piece such as screw or nut.

Therefore, a long standing need has existed to provide a means for improving the twisting torque of a tool handle whereby increased leverage is provided for dislodging extra tightened work pieces or work elements which are stuck in place.

SUMMARY OF THE INVENTION

Accordingly, the above problems and difficulties are obviated by the present invention which provides a novel tool handle having an elongated body substantially surrounding a rigid rod which terminates at one end in a cross bar having opposite ends. Each end of the cross bar pivotally carries a grip member which is adapted to rotate out of a storage recess provided in the handle from a storage position into an operative position cantilevered outwardly in a lateral manner from opposite sides of the handle. Storage recesses are provided in the handle for accommodating each of the grip members when in the storage position and biasing means are provided for yieldably maintaining each of the respective grip members in either the operative position or the storage position.

Therefore, it is among the primary objects of the present invention to provide a novel tool handle adapted to increase twisting torque by means of grip members laterally extending outwardly from opposite sides of the handle.

Another object of the present invention is to provide a novel tool handle having grip members pivotally carried thereon positionable between a storage position within the handle and movable into an operative position cantilevered outwardly from opposite sides of the handle.

Yet another object of the present invention is to provide a novel handle grip for a tool whereby twisting torque is greatly increased so that additional leverage is gained for dislodging a work piece.

Still a further object of the present invention is to provide a novel tool handle having rotating means for gaining additional leverage which is relatively easy to manufacture and inexpensive to fabricate.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is an exploded perspective view illustrating the novel tool handle incorporating the present invention;

FIG. 2 is a longitudinal cross-sectional view of the tool handle shown in FIG. 1;

FIG. 3 is a transverse cross-sectional view of the tool handle shown in FIG. 2 as taken in the general direction of arrows 3—3 thereof; and FIG. 4 is a fragmentary sectional view of the tool handle illustrating the grip member pivotal means as well as the biasing means.

DESCRIPTION OF THE PREFERRED EMBODIMENT

Referring to FIG. 1, the novel tool handle of the present invention is shown in the general direction of arrow 10 which includes an elongated body 11 having a cap 12 at one end and a ratchet mechanism 13 at its opposite end. The ratchet mechanism includes a stub 14 to which a variety of tools can be attached. For example, and illustrated, a typical screwdriver for a slotted screw is illustrated by numeral 15 which depends from a conventional socket 16 which is formed with a shaped receptacle 17 adapted to insertably receive the stub 14. A releasable latch or lock mechanism is indicated by numeral 18 which is of a conventional spring-loaded ball type. However, it is to be understood that the ratchet mechanism as well as the specific tool 15 does not form part of the present invention since these are conventional components.

The tool handle 10 further includes a pair of grip members 20 and 21 which extend outwardly from opposite sides of the body 11 in a coextensive relationship adjacent to the cap 12 provided at one end of the body 11. As shown in FIG. 1, the grip members 20 and 21 are in an operative position so that when the user's palm is placed on cap 12, the fingers of the same hand can be manipulated about one or both of the grip members so that when the user's hand is rotated, added leverage is provided for turning the tool 15 via the handle 10. Also, as shown in FIG. 1, the body 11 is provided with a pair of receptacles such as receptacle 22 for receiving each of the grip members for storage purposes. The grip members 20 and 21 are readily positionable between the lateral and outwardly extended position as shown in solid lines representative of the operative position into the respective storage recesses representing the storage position. Preferably, the major length of each of the grip members is round or rod-like while one end or portion of each of the grip members is of square cross-section as indicated by numeral 23. The opposite or free ends of each of the rod members includes a slot 24 which may insertably receive the fingernail from a finger of the user when it is desired to pull a respective grip member from its storage recess 22 to the operative position shown in solid lines.

Referring now in detail to FIG. 2, it can be seen that respective grip members 20 and 21 are in the storage recesses provided on opposite sides of the handle 11 as shown in solid lines. In broken lines, the grip members are illustrated in the lateral or extended operative position. It can also be seen that the device includes a central rod 25 extending along the central longitudinal axis of the body 11 and which terminates in a cross bar or member 26 having opposite ends forming a pair of yokes generally illustrated by numerals 27 and 28 in FIG. 3. One end of each of the respective grip members 20 and 21 are pivotally connected to each of the respective yokes and the pivots are indicated by numerals 30 and 31 respectively.

A biasing mechanism is included in the present invention which comprises a bar 32 placed across the top of the cross bar 26 and extending over each yoke 27 and 28 so that the opposite ends of the bar 32 will engage with the pivotal end of each of the respective grip members 20 and 21 in either the operative position or the storage position. The biasing bar or member 32 is carried in a transverse cavity 33 so that limited movement is permitted between the cross bar 26 and the underside of the cavity associated with end cap 12. The biasing bar or member 32 is maintained in yieldable contact or engagement with the ends of the grip members 20 and 21 by means of a spring 34 mounted about a screw 35 carried within a bore of end cap 12. The screw 35 slidably passes through a hole in the bar 32 and threadably engages with the cross bar 26. Therefore, it can be seen that when the grip members are shown in the storage position, the opposite ends of bar 32 will press against these ends because of the spring 34. However, when the grip members are moved to the operative position as shown in broken lines in FIG. 2, the opposite ends of the bar 32 will press against the flat portion 23 of each of the grip members. In either the operative or storage position, the spring 34 will provide a sufficient bias to maintain each of the grip members in the respective position. However, it is to be understood that this pressure is yieldable so that when each of the respective grip members is moved or pivoted, the bar 32 will raise or move within the cavity 33 against the expansion of spring 34 so as to apply the yieldable pressure to the grip members. In order to provide for a smooth pivoting of the grip members, inside corners of each of the grip members are rounded so that no interference will occur between the yoke portion of the cross bar and the square or flat portion 23 of the grip members. Such a curved corner is indicated by the numeral 36 in connection with grip member 20.

Preferably, the cylindrical body 11 is tapered from the cap end 12 to the ratchet end 13 so that a portion of the free end of each of the grip members extends beyond the periphery of the body 11 whereby the notch 24 is partially exposed. This permits the user to readily insert a fingernail into the notch when it is desired to pivot each of the grip members outwardly into the operative position. Therefore, it is to be understood that the respective grip members are not totally enclosed within the storage receptacle 22.

Referring now in detail to FIG. 3, it can be seen that yokes 27 and 28 rotatably support the adjacent ends of the respective grip members 20 and 21 by means of pivots 30 and 31. Also, it can be seen that the grip members are substantialy coextensive in the expanded or operative position and that the grip members extend outwardly from opposite sides of the body 11 so as to be substantially cantilevered therefrom.

Referring now in detail to FIG. 4, it can be seen that the cap end 12 is rounded so as to accommodate the palm of the user. Also, it can be seen that the spring 34 is compressed between the head of screw 35 and the top of the bar 32. FIG. 4 further shows the taper of the body 11 from the cap end 12 downwardly towards the opposite end and that the respective grip members, such as grip member 20, is pivotally carried between the side pieces of yoke 27. The flat or square end of the grip member is indicated by numeral 23 prime which is equivalent to the construction of the flat or square end 23 carried on grip member 21.

In actual use, the user will place a suitable tool 15 onto the attachment stub 14. The tool may be a screwdriver, a socket wrench or any other suitable tool. Next, the user will extract each of the respective grip members 20 and 21 from the storage recesses 22 into the operative position shown in solid lines in FIG. 1. In one orientation, the user will put the palm of his hand against the end 12 and place his fingers and thumb adjacent to the respective grip members and apply both downward and rotating pressure to the body 11. The load forces encountered by the twist or rotational application of the pressure is translated directly into the bar 26 via the yokes 27 and 28 and then into the rod 25 for direct application through the ratchet 13 to the tool 15. The spring biasing means maintains each of the grip members in either the operative or storage position and each of the members is controllably deployed between the two positions by the biasing means since the expansion force of spring 34 is constantly applied to the bias bar 32.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A tool handle for applying a twisting or torque loads to a tool, the combination comprising:

an elongated rounded body having opposite ends;

a pair of elongated grip members pivotally carried adjacent one end of said body adapted to be deployed between a storage position substantially parallel to the longitudinal axis of said body and an operative position outwardly and laterally extending from opposite sides of said body;

biasing means operably carried on said body for applying a yieldable pressure or load on said grip members constituting an over-the-center toggle mechanism so as to bias said grip members in either said storage position or said operated position;

load transference means interconnecting said grip members with said body for transferring torque load forces therebetween;

said load transference means includes an elongated rod coaxially disposed along the central longitudinal axis of said body terminating in a cross bar having a yoke provided in the opposite ends of said cross bar;

each of said grip members is pivotally coupled to each of said cross bar yokes respectively so that each of said grip members move between said storage and said operative positions.

2. The invention as defined in claim 1 wherein:

said biasing means includes a bias bar extending across said cross bar yokes and resilient means forcibly urging said bias bar thereagainst in a yieldable manner so as to normally bear against the ends of said grip members.

3. The invention as defined in claim 2 wherein:

said biasing means constitutes an over-the-center toggle mechanism to normally bias said grio members into either of said storage or operative positions wherein the ends of grip members include a flat surface engageable by the opposite ends of said bias bar.

4. The invention as defined in claim 3 wherein:

said body provided with a pair of storage recesses on opposite sides thereof for receiving said grip members respectively in their storage position.

5. The invention as defined in claim 4 wherein:

said body is tapered and said grip member pivotal connections are located adjacent the greater diameter of said body taper so that a portion of the free ends of said grip members reside beyond the periphery of said body; and said last mentioned portions serving as grasping portions for manually deploying said grip members from said storage position to said operative position.

6. The invention as defined in claim 5 wherein:

said grip member free ends terminate in a slot for insertably accepting a fingernail of the user for starting said last mentioned deployment.

* * * * *